United States Patent [19]

Kronseder

[11] Patent Number: 4,685,417

[45] Date of Patent: Aug. 11, 1987

[54] GLUING DEVICE FOR LABELING MACHINES

[76] Inventor: Hermann Kronseder, Regensburger Str. 42, 8404 Worth/Donau, Fed. Rep. of Germany

[21] Appl. No.: 853,971

[22] Filed: Apr. 21, 1986

[30] Foreign Application Priority Data

Apr. 23, 1985 [DE] Fed. Rep. of Germany ..... 3514618

[51] Int. Cl.[4] ..... B05C 1/02

[52] U.S. Cl. ..... 118/261; 101/365

[58] Field of Search ..... 118/261; 101/365

[56] References Cited

U.S. PATENT DOCUMENTS 1,957,470 5/1934 Milmoe ..... 118/261 X 3,727,550 4/1973 Easoz et al. ..... 101/365

*Primary Examiner*—John P. McIntosh

*Attorney, Agent, or Firm*—Fuller, Puerner & Hohenfeldt

[57] ABSTRACT

A glue applying device for a labeling machine equipped with a roller rotating about a vertical axis while a mass of glue is fed to one side. A glue scraper blade is mounted for swinging about a vertical axis into a position where the blade edge wipes off the mass of glue and leaves a film of glue on the roller. A lever extends radially from the blade axis. A micrometer adjustment screw is threaded through a pivoting arm for its tip to act on the lever. The screw has a turning knob in which a graduated thickness indicating dial is rotatable. A block is mounted to the arm and it has a bore through which the adjustment screw passes. There is an index mark on the block next to the dial. A compression spring in the bore holds the knob against self rotation. When the screw is turned to its limit against the lever, the dial is turned in the knob until the zero mark on the dial scale aligns with the index mark.

4 Claims, 2 Drawing Figures

GLUING DEVICE FOR LABELING MACHINES

BACKGROUND OF THE INVENTION

The invention disclosed herein pertains to a device for applying glue to labels in a container labeling machine.

A labeling machine should be able to apply labels of various configuration accurately on containers having various shapes. In their development, gluing devices have been adapted to account for use of various glues, differing qualities of labels and ever increasing working speeds. In any case, minimizing the glue consumption, accurate placement of the labels on the containers, good adhesion and lack of glue smearing are of great significance. Successful operation of gluing devices depends to a large extent on accurate control of the thickness of the film of glue on the roller with which pick-up elements for labels are contacted to transfer glue to them. Obtaining and maintaining optimal glue film thickness on the rollers has been achieved. This is done simply by holding the edge of a straight doctor blade or scraper close to the revolving glue transfer roller. The scraper is usually mounted on an axis that is parallel to the axis of the roller and that permits swinging the blade toward and away from the roller to obtain the desired glue thickness. A common practice is to have a threaded stud mounted in a fixed support such that the stud can be turned toward or away from the glue scraper and in contact with it in opposition to a spring for obtaining film thickness adjustment. A locknut is placed on the stud and it is tightened against the support when correct adjustment has finally been made. This traditional blade adjustment means results in much time being consumed in trying to establish the edge of the blade at the proper distance for obtaining the exact glue film thickness desired for the particular labels being used. Using a threaded stud provides no gauge as to whether the scraper is too close or too far from the roller, so usually iterative adjustment or adjustment by trial and error must be made. So there would be several attempts at adjustment before it was felt that the distance between the glue scraper and the roller was optimal for a majority of the labels being processed. Iterative adjustment procedures are not acceptable in high speed modern labeling machines.

SUMMARY OF THE INVENTION

An objective of the present invention is to provide a gluing device wherein the adjustment of the glue film thickness on the glue transfer roller can be accomplished simply, accurately and predictably.

Briefly stated, in accordance with the invention, the scraper blade is mounted on a shaft for rotation toward and away from the periphery of the glue-coated roller. The mounting of the blade which turns on a vertical shaft has an arm extending from it. A spring biases the arm in such manner that the arm tends to rotate in a direction that brings the edge of the scraper blade closer to the glue roller. A screw is mounted in another arm and there is a graduated scale on the screw which is calibratable on the machine. The screw has a fine thread in the nature of a micrometer and the tip of the screw applies a force to the spring biased arm in opposition to the spring which means that the screw can govern the distance or the amount by which the scraper blade is moved away from the glue roller. The arrangement is such that the calibrated scale can be zeroed for every different labeling run. The latter is an important feature.

The manner in which the foregoing objectives and features of the new glue film controlling device are achieved will be evident in the ensuing detailed description of a preferred embodiment of the invention which will now be set forth in reference to the drawing.

DESCRIPTION OF A PREFERRED EMBODIMENT

Figure 1:
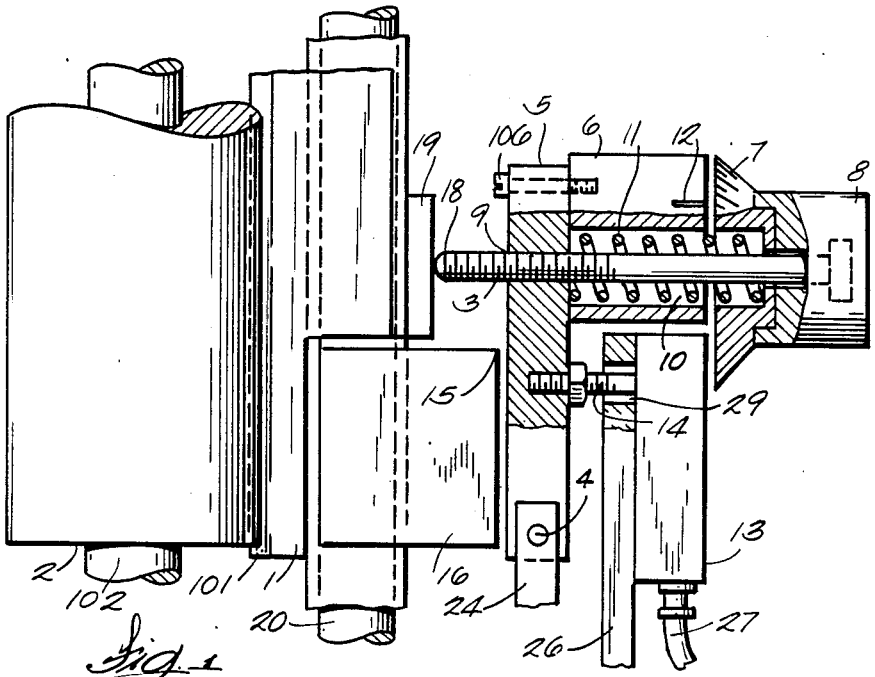
FIG. 1 is a side elevation view, partially in section, of the new glue film controlling device.
Figure 2:
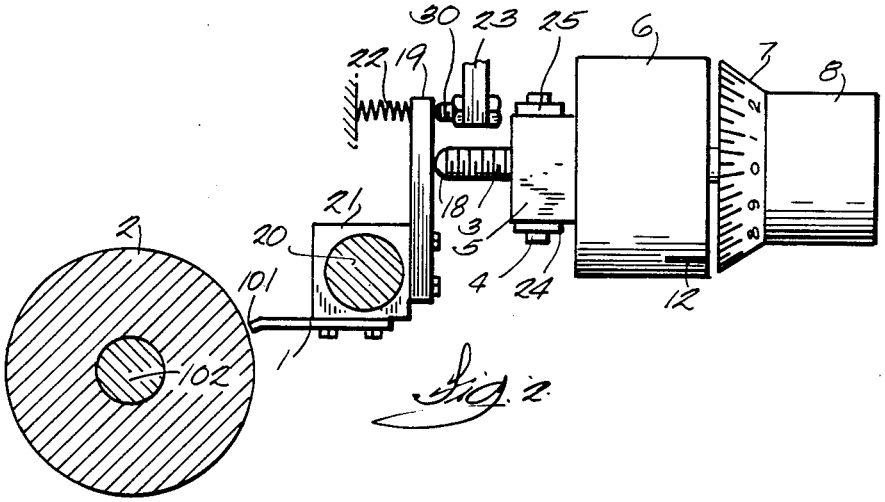
FIG. 2 is a plan view of the device in the preceding figure.

In the drawing, only those parts of the device which are required for comprehending the invention are illustrated. The device comprises a scraper blade or excess glue stripper 1. The glue roller is marked 2. The roller turns with a shaft 102 whose axis is vertical. The edge 101 of stripper blade 1 is at a distance from the periphery of the roller which is appropriate for the type and viscosity of the glue being used and the nature of the labels being applied to containers, not shown. There is a bracket, similar to a yoke having two upstanding legs 24 and 25 mounted on the machine adjacent scraper blade 1. An arm 5 is pivotally connected to this yoke for the arm to pivot on a pin 4. Arm 5 has an internally threaded hole 9 passing through it. An externally threaded adjustment screw stem 3 is turned into threaded hole 9. Stem 3 passes through a mounting block 6 and terminates in an adjustment knob 8 in which the unthreaded end of stem 3 is molded. The knob 8 has set in it a dial element collar 7 which has a conically shaped rim graduated, for example, in tenths of a millimeter. Knob 8 and collar 7 are rotatable relative to each other. An index mark 12 provides the reference point for reading the value off of the graduated scale on collar 7. Swingable arm 5 is fastened to mounting block 6 by way of screws such as the one marked 106. Mounting block 6 has a bore 10 through which adjusting stem 3 passes freely. Bore 10 continues into the conical dial element 7 and has about the same diameter in the mounting block 6 as in the conical dial element 7. A compression spring 11 surrounds adjustment stem 3. This spring is pre-stressed in compression and is captured between the inside surface of arm 5 and a surface within dial collar 7 such that the spring imposes a frictional force on the dial collar 7 and, hence, on the knob, to prevent the knob from turning inadvertently. Thus, screw 3 will not rotate from the position in which it is manually adjusted.

Automatic adjustment of the edge 101 of the glue scraper 1 relative to roller 2 is achieved with a pneumatic servomotor 13. Servomotor 13 is actuated by air supplied through a hose 27 which leads back to a control valve, not shown. An operating stem 14 extends from servomotor 13 and through clearance hole 29. The head end of stem 14 connects with one face of swingable arm 5. It will be evident that servomotor 13 can actuate operating stem 14 in such manner that the stem can exert a pushing force on swingable arm 5 or it can be retracted to allow the arm and hence the tip 18 of screw 3 to be retracted. A mount 16 is fixed on the machine as shown in FIG. 1 and it has a corner 15 that acts as a final limiting stop for swingable arm 5. Arm 5 is moved back and forth by means of the servomotor 13 between a normal working position and a neutral position, resulting in a smaller gap width. The free rounded tip 18 of adjusting stem 3 is in contact with a lever 19 which swivels with a bearing block 21 on a stationary vertical shaft 20. A compression spring 22 tends to rotate lever 19 in a direction which brings the scraper blade 1 farther from the periphery of roller 2. The amount of travel, of course, of lever 19 is governed by the adjustment position of adjustment screw 3. A stop bolt 30 having a locknut is threaded into a fixed support element 23. The adjustment for a smaller or larger gap between the scraper 1 and the glue transfer roller is carried out by rotating knob 8.

The mounting block 6 which is permanently connected to swingable arm 5 is rounded at its top correspondingly to the radius of the scale portion of the adjustment knob. The roller 2 can have a metallic periphery and the adjusting screw 3 can be dimensioned such that the glue scraper can be brought into the normal working position in contact with the periphery of roller 2 so that the scale or collar 7 is set to zero by turning dial collar 7 relative to knob 8. In other words, when making the initial adjustment of the scraper to glue roller distance, adjustment screw 3 is advanced inwardly by turning knob 8. This will result in arm 19 pivoting on shaft 20 and scraper blade edge 101 will eventually come to a stop against glue roller 2. At that time the number on the collar 7 graduation that matches the index mark on block 6 is meaningless. However, now the user can hold knob 8 and rotate dial collar 7 until zero on the graduated scale aligns with the mark 12. Now knob 8 can be turned so that the scale on collar 7 will indicate a value corresponding to the distance the scraper blade edge 101 will be from the glue roller 2 when the scraper is in active position. On the scale 7, the set gap width can then be read exactly, for example, in tenths of a millimeter. The positioning of the scraper 1 in the neutral position, which lies very close to the gluing roller 2, takes place independent of the adjustment screw 3, for example, through stop 23 which acts on the lever 19.

I claim:

1. A device for applying glue to labels in a labeling machine comprising:

a roller on which excess glue is applied while rotating about a vertical axis, a scraper blade swingable about an axis parallel to the roller axis toward and away from the periphery of the roller for reducing the glue to a film on the roller, a stationary support and arm means mounted for pivoting about an axis on said support, said arm means having a threaded hole spaced from said axis, an adjustment screw in said threaded hole extending from one side of said arm means and adjustable to set the distance said blade is allowed to swing relative to said roller, manually engageable screw turning means on said screw means on the side of said arm means opposite of said one side, said screw turning means including a handle fastened to said screw means and an adjacent collar having a graduated scale thereon indicative of the distance between said blade and said glue roller and the thickness of the glue film, said collar being coaxial with said handle and in frictional contact therewith, said collar being rotatable relative to said handle adjacent an index mark on said arm means, and means for pressing said collar resiliently against said handle such that for any adjusted position of said screw means said collar may be turned relative to said handle to set the zero mark on said scale in line with said index mark.

2. The device according to claim 1 including:

a body comprising a part of said arm means, said body having a bore through which said adjustment screw freely passes, said means for pressing said collar resiliently consisting of a compression spring concentric to said adjustment screw in said bore and interposed between said arm means and said collar.

3. The device according to claim 3 wherein said collar is circular about an axis coincident with the axis of said adjustment screw means and said scale on said collar is formed in a circle, said body of said arm means has a curved surface having substantially the same radius of curvature as said collar so the periphery of said collar and said curved surface are coincident.

4. A device for applying glue to labels in a labeling machine comprising:

a roller on which excess glue is applied while rotating about a vertical axis, a scraper blade swingable about an axis parallel to the roller axis toward and away from the periphery of the roller for reducing the glue to a film on the roller, a stationary support and arm means mounted for pivoting about an axis on said support, said arm means having a threaded hole spaced from said axis, an adjustment screw in said threaded hole extending from one side of said arm means and adjustable to set the distance said blade is allowed to swing relative to said roller, manually engageable screw turning means on said screw means on the side of said arm means opposite of said one side, said screw turning means having a graduated scale thereon indicative of the distance between said blade and said glue roller and the thickness of the glue film, a servomotor mounted adjacent said arm means, and means operatively connecting said servomotor to said arm means for said servomotor to swing said arm means and correspondingly swing said scraper blade between inactive and active positions relative to said glue roller.

* * * * *

UNITED STATES PATENT AND TRADEMARK OFFICE

CERTIFICATE OF CORRECTION

PATENT NO. : 4,685,417

DATED : August 11, 1987

INVENTOR(S) : Hermann Kronseder

It is certified that error appears in the above—identified patent and that said Letters Patent is hereby corrected as shown below:

Column 4, Claim 3, Line 25 After "claim" delete "3" and substitute therefor ---2---.

Signed and Sealed this

First Day of March, 1988

*Attest:*

*Attesting Officer*

DONALD J. QUIGG

*Commissioner of Patents and Trademarks*